US007952470B2

(12) United States Patent
Liao et al.

(10) Patent No.: US 7,952,470 B2
(45) Date of Patent: May 31, 2011

(54) COLLISION DETECTION APPARATUS, COLLISION DETECTING METHOD AND ROBOT AND VACUUM CLEANER USING THE SAME

(75) Inventors: Ching-Chi Liao, Taichung County (TW); Yen-Chieh Mao, Kaohsiung (TW); Lai-Sheng Chen, Hsinchu (TW); Yu-Liang Chung, Taipei (TW); Yann-Shuoh Sun, Taipei County (TW); Nai-Chia Chang, Tainan County (TW)

(73) Assignee: Industrial Technology Research Institute, Hsinchu (TW)

( * ) Notice: Subject to any disclaimer, the term of this patent is extended or adjusted under 35 U.S.C. 154(b) by 730 days.

(21) Appl. No.: 11/674,162

(22) Filed: Feb. 13, 2007

(65) Prior Publication Data

US 2008/0117034 A1 May 22, 2008

(30) Foreign Application Priority Data

Nov. 16, 2006 (TW) ..... 95142395 A

(51) Int. Cl.
*B60Q 1/00* (2006.01)

(52) U.S. Cl. ..... 340/436; 15/325; 318/568.12; 340/438; 700/245; 901/1; 901/46; 901/49; 901/50

(58) Field of Classification Search ..... 15/325
See application file for complete search history.

(56) References Cited

U.S. PATENT DOCUMENTS

| | | | | |
|---|---|---|---|---|
| 4,865,388 | A * | 9/1989 | Nemoto | 297/403 |
| 5,060,932 | A * | 10/1991 | Yamaguchi | 472/47 |
| 5,575,497 | A * | 11/1996 | Suyama et al. | 280/730.1 |
| 2002/0037707 | A1 * | 3/2002 | Yoshioka et al. | 455/404 |
| 2004/0164535 | A1 * | 8/2004 | Katsuda | 280/737 |
| 2006/0074338 | A1 * | 4/2006 | Greenwald et al. | 600/549 |
| 2006/0163833 | A1 * | 7/2006 | Haire | 280/124.116 |
| 2006/0231321 | A1 * | 10/2006 | Takahashi | 180/274 |
| 2006/0260090 | A1 * | 11/2006 | Kim | 15/325 |
| 2006/0276965 | A1 * | 12/2006 | Ide | 701/301 |

FOREIGN PATENT DOCUMENTS

| | | |
|---|---|---|
| CN | 2452885 | 10/2001 |
| CN | 1493247 | 5/2004 |
| CN | 2664858 | 12/2004 |
| JP | 2002-117472 | 4/2002 |
| JP | 2005-040596 | 2/2005 |
| JP | 2006-290260 | 10/2006 |

OTHER PUBLICATIONS

"Notice of Allowance of Taiwan counterpart application", issued on Nov. 26, 2009, p. 1-p. 3.

* cited by examiner

*Primary Examiner* — Benjamin C Lee
*Assistant Examiner* — Curtis J King
(74) *Attorney, Agent, or Firm* — Jianq Chyun IP Office

(57) ABSTRACT

A collision detection apparatus is provided, which includes a main body, at least an air bag disposed at the periphery of the main body and at least a baro sensor. The air bags communicate with each other. The air bag is connected to the baro sensor to detect the pressure at different time points and the pressure variations. The apparatus judges whether a collision has occurred and the collision force is detected by the baro sensors. The time point of collision occurrence and the collision position according to the pressures of the air bags at different time points are determined.

21 Claims, 7 Drawing Sheets

COLLISION DETECTION APPARATUS, COLLISION DETECTING METHOD AND ROBOT AND VACUUM CLEANER USING THE SAME

CROSS-REFERENCE TO RELATED APPLICATION

This application claims the priority benefit of Taiwan application serial no. 95142395, filed Nov. 16, 2006. All disclosure of the Taiwan application is incorporated herein by reference.

BACKGROUND OF THE INVENTION

1. Field of the Invention

The present invention generally relates to a collision detection apparatus, a collision detection method and the robot and vacuum cleaner using the same.

2. Description of Related Art

A mobile intelligent robot, from the cradle phase to fully developed phase thereof, has closely bound the technologies, such as mechanism design, electrical control design, kinetic control theory and sensors.

In order to make a mobile intelligent robot, the robot needs to know the relative position between the surrounding obstructions, thus, collision detection is an important topic. In addition, collision detection also serves as a guard line for a robot movements in an environment with obstructions. That is to say, a robot would not get damaged or hurt any object in the environment during the movement thereof, especially human body, by all means.

The existing collision detection method is roughly classified into two schemes: to calculate the object position by means of video/audio data, which requires numerous computations to detect the obstructing object position by using a collision detecting system. The advantage and the disadvantage of each the scheme are described in the following.

With the contact-type collision detection method, an anti-collision retraction lever is used to detect whether an object is touched so as to judge a collision occurrence. In more detail, one or more anti-collision retraction levers are disposed on the periphery of a robot's main body and the anti-collision retraction lever is linked with a linkage mechanism where a light-blocking proximity sensor or a touch sensor is connected thereto. Once a collision occurs, the articulator-like linkage would rock, and the light-blocking proximity sensor or the touch sensor would sense the rocking movement to make the robot aware of the collision. However, the disadvantage of the detection method is that it fails to detect the extent of collision, for example, the amount of collision force, although it detects the collision occurrence. Beside, restricted by the structure inherence of the anti-collision retraction lever and the internal levers thereof, the method is unlikely to achieve the effects of a soft collision and automatic shock-absorption due to a limited resolution, when the anti-collision retraction lever of a robot encounters a collision, the method fails to accurately identify the orientation of the collision point so that the robot is unable to correctly determine a collision-free route. Furthermore, a risk of false action exists with the robot, for example, for a detection apparatus which is designed to function only when the anti-collision retraction lever gets a translation movement and the linkage mechanism rocks caused by a collision, if only an edge of the anti-collision retraction lever were collided, the linkage mechanism may not rock and the detection apparatus would be silent in response to a real collision; moreover, such a contact detection scheme may damage or hurt an obstructing object in a mobile environment, especially a human body.

With the collision detection method using an optical sensor, if an obstructing object were a blackbody incapable of reflecting light, the detection does not function. In other words, the optical collision detection method has a certain requirement on the surface of an obstructing object. On the other hand, if an obstructing object reflects light somewhere, rather than at the robot itself, the detection does not function as well. In other words, the detection angle with the optical collision detection method is limited.

With the collision detection method using an acoustic sensor, a huge computation is needed, which makes the method hard to be used for fast moving circumstance while keeping away from any obstructing object. Furthermore, the method also likely causes a false judgment of a route with a specific angle or a slope.

With the collision detection method using an impedance sensor, a circuit of driving the wheels of the robot keeps monitoring the voltage/current variations. If the driving motor turns with more effect, a decreased voltage and an increased current would be monitored, which indicates the robot encounters an obstructing object. But the same detection result can be given if the robot walks on lawn, carpet or hill, which causes a false judgment as well.

With the collision detection method using an magnetic sensor, a great number of magnetic bars is required to be disposed around in the working environment for the first time use, which is a troublesome task and the method is suitable for a factory with simple establishments only. In addition, the method is not able to detect a moving obstructing object that temporarily enters the environment; not to mention, a moving obstructing object such as a human or animal that dislikes to be adhered by a magnetic sticker.

With the collision detection method using an electronic map, although the position information of the obstructing objects provided by the electronic map can be used to avoid obstructions, but prior to completely creating the electronic map, the above-mentioned methods are still needed for initially avoiding obstructions. The error of the sensing system with the method would be increased all the time and needs to be always calibrated. Moreover, the method is unable to detect a moving obstructing object.

SUMMARY OF THE INVENTION

Accordingly, the present invention is directed to a collision detection apparatus and a collision detection method capable of not damaging or hurting an obstructing object in a mobile environment, especially a human body, and also capable of reducing and absorbing shock. The collision detection apparatus and the collision detection method is capable of detecting any collision as collision detection apparatus has high detection sensitivity and can obtain an accurate orientation result. The collision detection apparatus can be manufactured at a lower cost as it requires comparatively fewer components.

As embodied and broadly described herein, the present invention provides a collision detection apparatus, which includes a main body, at least an air bag located at the periphery of the main body, at least a baro sensor connected to the air bag for detecting the pressure variation of the air bag and a conversion circuit so as to convert the signal measured by the baro sensor into an analog or a digital electrical signal. By means of a pressure variation measured by the baro sensor, the collision detection apparatus judges whether a collision occurs and calculates the collision force.

The above-mentioned collision detection apparatus comprises a plurality of air bags and a plurality of baro sensors, wherein all the air bags communicates with each other, each air bag is connected to a corresponding baro sensor to detect pressure values of the air bag at different time points, and the collision range/collision position/collision angle and the time of collision occurrence are obtained by means of the pressure values of all the air bags at different time points.

In the above-mentioned collision detection apparatus, the air bags are positioned adjacent to each other, arranged in a sector and fixed along the periphery of the main body.

In the above-mentioned collision detection apparatus, the air bags can be integrally formed, and a through hole is formed between every two adjacent air bags and the pressure transmission between all the air bags and the delay of the pressure transmission can be achieved via the through holes.

In the above-mentioned collision detection apparatus, the air bags can be adjacent to each other, arranged in a ring and fixed along the periphery of the main body.

In the above-mentioned collision detection apparatus, the above-mentioned air bags are made of an elastic material.

The present invention also provides a robot, which employs the above-mentioned collision detection apparatus.

The present invention also provides a vacuum cleaner, which employs the above-mentioned collision detection apparatus.

The present invention further provides a collision detection method. The collision detection method may be described as follows. First, at least three air bags along the periphery of a main body are fixed. Next, a start point position $x_0$ and an end point position $x_e$ are specified, wherein the air bags communicate with each other by means of at least two through holes so as to transmit the pressure between the air bags and delay the pressure transmission. Next, the pressure values at the positions $x_1$, $x_2$ and $x_3$ corresponding to the air bags at different time points are detected and recorded respectively. Next, whether or not a collision occurs is judged and the collision force is calculated according to the pressure variations measured at the positions $x_1$, $x_2$ and $x_3$ of the air bags, wherein when a collision occurs at a collision position x and a time point $t_0$, the time points $t_1$, $t_2$ and $t_3$ respectively corresponding to the moments where the detected pressures at the position $x_1$, $x_2$ and $x_3$ reach a preset pressure are recorded, wherein $x_1$, $x_2$, $X_3$ and $x_e$ respectively represent the distances from the start point position $x_0$ to the positions along the air bags in a same clock direction. Next, the following simultaneous equations are listed where v represents pressure wave speed during transmission of the pressure between the air bags and determine the collision position x and the time point of collision occurrence $t_0$:

$$v(t_1-t_0)=\min\{(x_1-x),[x+(x_e-x_1)]\}$$

$$v(t_2-t_0)=\min\{(x_2-x),[x+(x_e-x_2)]\}$$

$$v(t_3-t_0)=\min\{(x_3-x),[x+(x_e-x_3)]\}$$

In the above-mentioned equations, the function min{ } represents an operation with minimal value among values within the bracket, the unknown variables are v, $t_0$ and x and the rest variables are known; therefore, the unique solutions of v, $t_0$ and x can be obtained.

In the above-mentioned collision detection method, the moment of reaching a preset pressure means the moment where the detected pressure of the air bags at the position $x_1$, $x_2$ or $x_3$ reaches a preset maximal value thereof or a preset reference pressure, or the moment where the detected pressure of the air bags at the position $x_1$, $x_2$ or $x_3$ starts rising.

In the above-mentioned collision detecting method, the calculated collision positions are the distances along the air bags counted from the starting point. Thus, the method can also be applied to the arrangement that air bags are arranged in various polygons. For the air bags arranged in a sector or a ring, the calculation of collision position can be simplified into the calculation of collision angle.

The present invention provides a collision detection method. The collision detection method may be described as follows. First, at least three air bags are fixed along the periphery of a main body, wherein the air bags are positioned adjacent to each other and arranged in a sector or a ring with a radius R, and a zero degree position $\theta_0$ and an end point angle position $\theta_e$ are specified and the air bags communicate with each other by means of at least two through holes so as to transmit the pressures between the air bags and delay the pressure transmission. Next, the pressure values at the angle positions $\theta_1$, $\theta_2$ and $\theta_3$ corresponding to the air bags at different time points are detected and recorded respectively. Next, whether an air bag experiences a collision is judged and the collision force is calculated according to the pressure variations measured at the angle positions $\theta_1$, $\theta_2$ and $\theta_3$ of the air bags, wherein when a collision occurs at an collision angle position $\theta_x$ and a time point $t_0$, the time points $t_1$, $t_2$ and $t_3$ respectively corresponding to the moments where the detected pressures at the angle positions $\theta_1$, $\theta_2$ and $\theta_3$ reach a preset pressure are recorded, wherein $\theta_1$, $\theta_2$, $\theta_3$, $\theta_x$ and $\theta_e$ respectively represent the angles from the zero degree position $\theta_0$ to the angle positions along the air bags in a same clock direction. Next, the following equations where v represents pressure wave speed during transmission of the pressure between the air bags are listed and the collision angle position $\theta_x$ and the time point of collision occurrence $t_0$is determined as follows:

$$v(t_1-t_0)=\min\{R(\theta_1-\theta_x),R[\theta_x+(\theta_e-\theta_1)]\}$$

$$v(t_2-t_0)=\min\{R(\theta_2-\theta_x),R[\theta_x+(\theta_x-\theta_2)]\}$$

$$v(t_3-t_0)=\min\{R(\theta_3-\theta_x),R[\theta_x+(\theta_e-\theta_3)]\}$$

In the above-mentioned equations, the function min{ } represents an operation with minimal value among values within the bracket, the unknown variables are v, $t_0$ and $\theta_x$ and the rest variables are known; therefore, the unique solutions of v, $t_0$ and $\theta_x$ can be obtained.

The above-mentioned collision detection method further includes calculating the collision force according to the pressure variations between prior to and after a collision at the positions $x_1$, $x_2$ and $x_3$ or at the angle positions $\theta_1$, $\theta_2$ and $\theta_3$.

The above-mentioned method of calculating a collision force based on the pressure variations includes: performing a set of experiments in advance, wherein the air bags are collided with different collision forces and the pressure variations of the air bags under the different collision forces are recorded so as to establish a look-up table; and calculating the collision force corresponding to the occurred collision by using the look-up table.

According to an aspect of the present invention, air bags incorporated with baro sensors may be employed for achieving multiple functions of buffering collision, shock absorption, detection of occurrence of a collision, detection of collision force and collision orientation/position, and a few baro sensors may be employed to precisely sense a direction-detection result. The collision detection apparatus is designed by using all immobile parts with a simpler and reliable structure. Besides, the collision detection apparatus of the present invention requires only a few components and is highly sensitive to collision so that it is capable very accurately detecting a collision.

In a robot or a vacuum cleaner application using the collision detection apparatus and the collision detection method of the present invention, since the collision detection apparatus itself has a shock-absorbing effect, the robot or the vacuum cleaner need not include any additional shock-absorbing structure. Moreover, once a collision occurs, the collided object and the collision detection apparatus or the collided robot/vacuum cleaner using the collision detection apparatus suffer a lighter impact.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

The First Embodiment

The Collision Detection Apparatus

Figure 1:
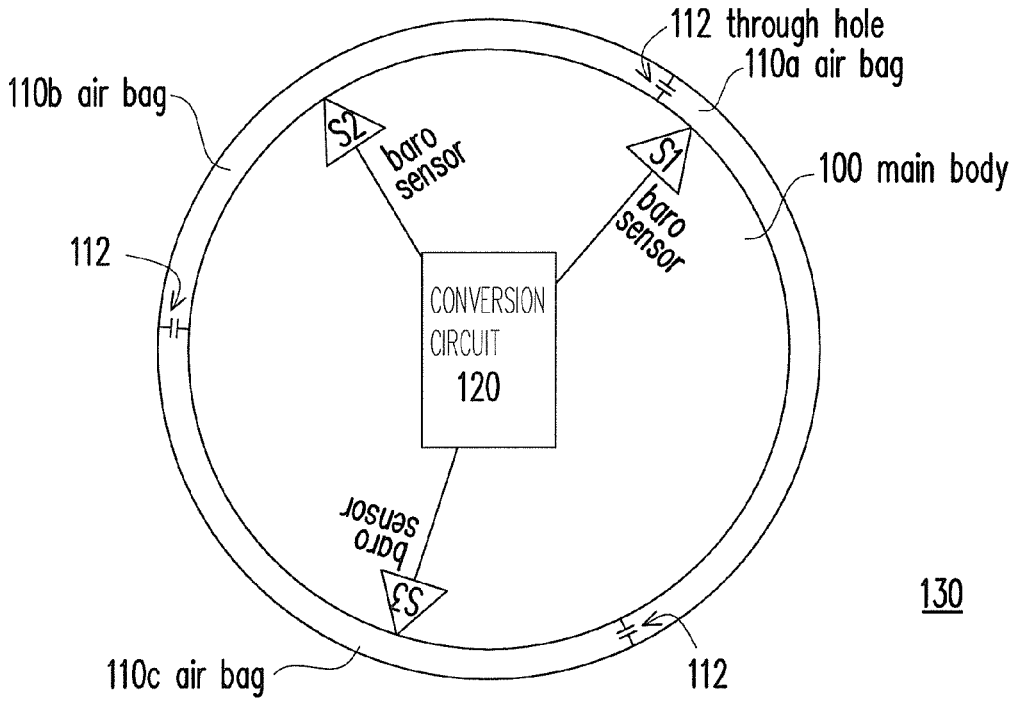
FIG. 1 is a top view diagram of a collision detection apparatus according to a first embodiment of the present invention.

FIG. 1 shows a top view diagram of a collision detection apparatus according to the first embodiment of the present invention.

A collision detection apparatus 130 includes a main body 100, at least an air bag located at the periphery of the main body 100, for example, three air bags 110*a*, 110*b* and 110*c* are shown in FIG. 1, and at least a baro sensor, for example, three baro sensors S1, S2 and S3 are shown in the figure and a conversion circuit 120.

The air bags 110*a*, 110*b* and 110*c* are positioned adjacent to each other, arranged in a sector or a ring (for example, in a ring as shown by FIG. 1) and fixed along the periphery of the main body 100. The air bags 110*a*, 110*b* and 110*c* are communicate with each other. The air bags 110*a*, 110*b* and 110*c* are comprised of, for example, an elastic material and integrally formed. A plurality of through holes 112 are formed between every two adjacent air bags. The pressure transmission between all the air bags 110*a*, 110*b* and 110*c* and the delay of the pressure transmission are achieved via the through holes 112.

The baro sensors S1, S2 and S3 are respectively connected to the air bags 110*a*, 110*b* and 110*c* to detect pressure values of the air bags at different time points and a graph of pressure versus time, i.e. a P-t graph, is obtained.

The conversion circuit 120 converts the signals measured by the baro sensors S1, S2 and S3 into an analog or a digital electrical signal.

By means of pressure variations measured by the baro sensors S1, S2 and S3, the collision detection apparatus 130 judges whether a collision occurs and calculates the collision force. Furthermore, by means of the P-t graph (shown by FIG. 3) the collision detection apparatus 130, the collision range/collision position/collision angle and the time of collision occurrence are determined. The method of detecting the time of collision occurrence, the collision force and the collision range/collision position/collision angle would be described in detail hereinafter.

The collision detection apparatus 130 can be employed in many applications, for example, the apparatus can be assembled on the main body of a robot or a vacuum cleaner. The main body 100 is replaced by the main body of a robot or a vacuum cleaner and in this way, the robot or the vacuum cleaner would have multiple functions of collision protection, detecting the time of collision occurrence and collision force and collision position.

The Collision Detecting Method

Figure 2:
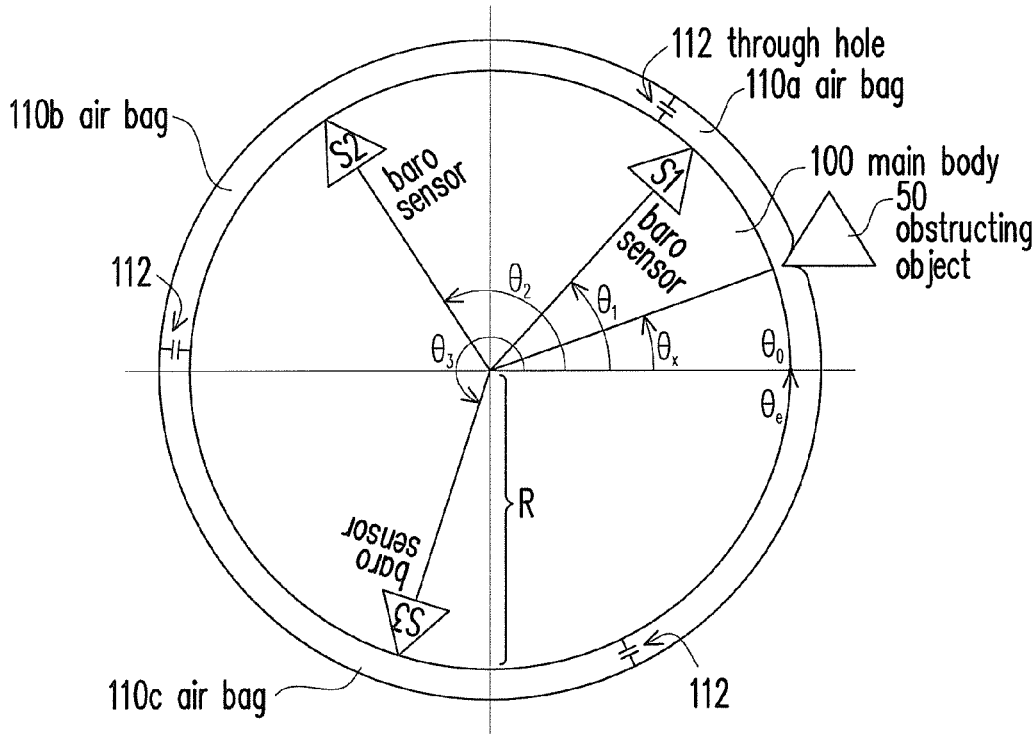
FIG. 2 is a diagram illustrating the collision detection apparatus of FIG. 1 during a collision.
Figure 3:
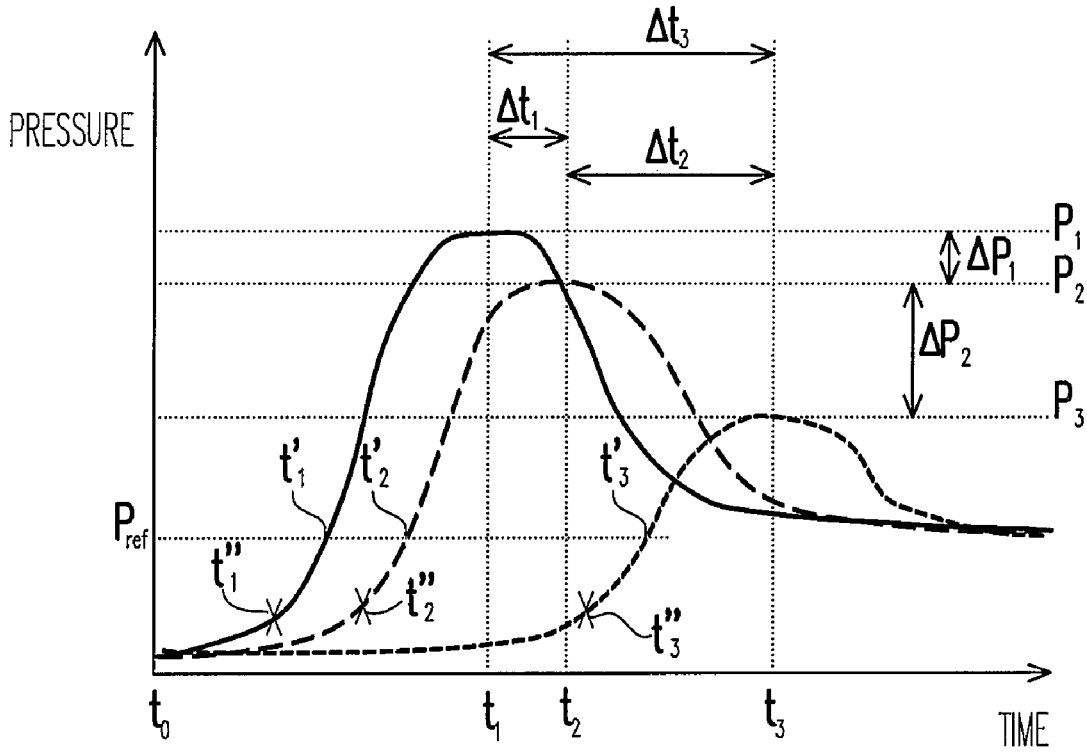
FIG. 3 is a graph of pressure versus time measured by the baro sensors of a collision detection apparatus of the present invention and the data reflect the pressures prior to and after the collision.
Figure 4:
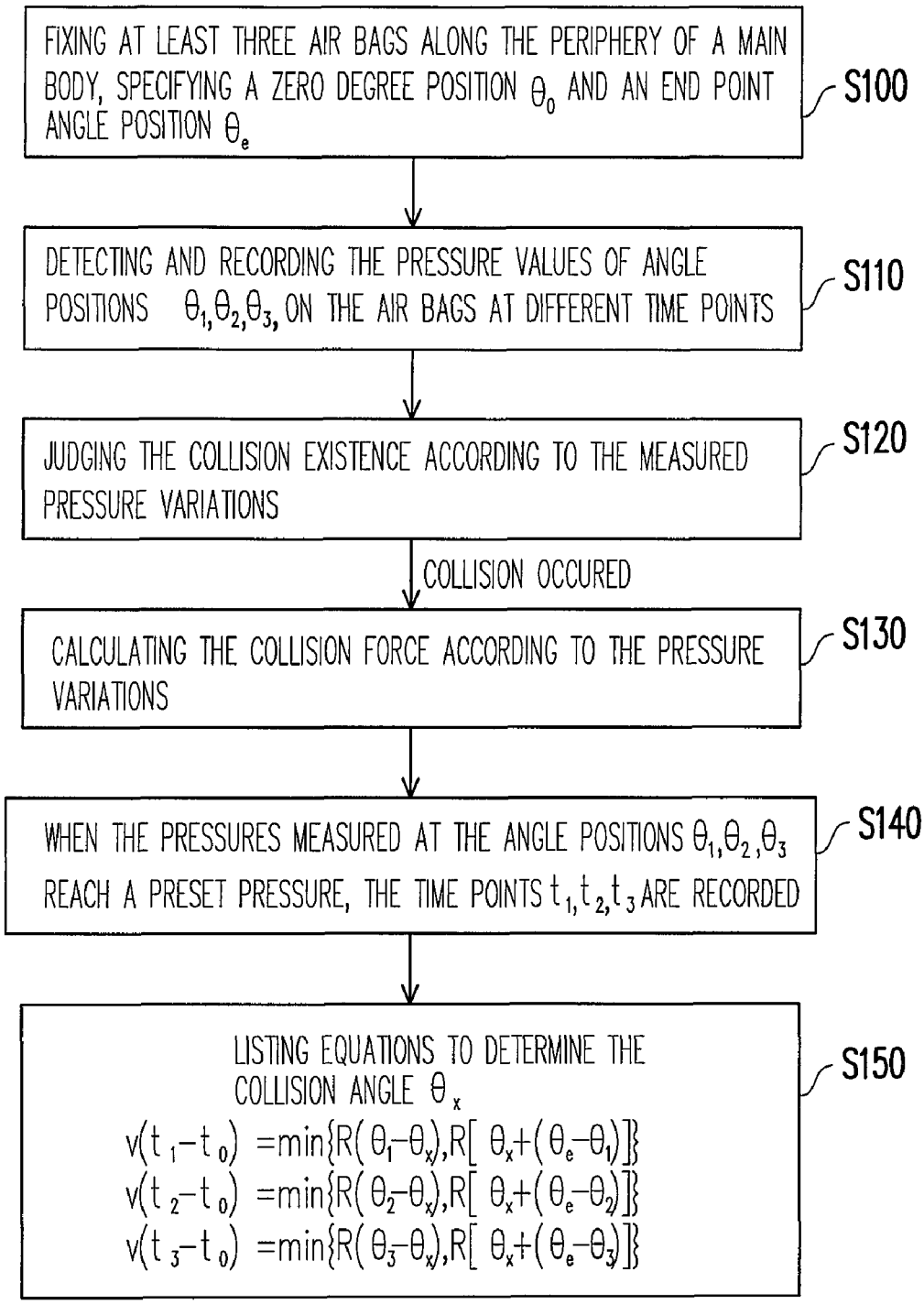
FIG. 4 is a flowchart showing the collision detection method of the collision detection apparatus in FIG. 1.

Referring to FIGS. 2-4, a collision detection method according to the first embodiment of the present invention is described in detail. FIG. 2 is a diagram illustrating the situation where the air bags are collided by an obstruct, FIG. 3 is a graph of pressure versus time measured by the baro sensors located in different angles or at different positions at different time points and FIG. 4 is a flowchart showing the collision detection method according to the first embodiment of the present invention.

Referring to FIGS. 2 and 4, in step S100, at least three air bags are fixed along the periphery of the main body. In the embodiment, for example, three air bags 110*a*, 110*b* and 110*c* are positioned adjacent to each other and arranged in a sector or a ring with a radius R (for example, a ring enclosing the main body 100 along a whole periphery in FIG. 2), and a zero degree position $\theta_0$ and an end point angle position of $\theta_e$ are specified (for the case of enclosing the main body along a whole periphery, $\theta_e=2\pi$) and the air bags 110*a*, 110*b* and 110*c* are communicated with each other by means of at least two through holes 112 so as to transmit the pressures between the air bags 110*a*, 110*b* and 110*c* and delay the pressure transmission.

In the above-mentioned step S100, the main body 100 can be the main body of a robot or the main body of a vacuum cleaner depending on the object with a need to detect collision.

Next, in step S110, the pressure values at the angle positions $\theta_1$, $\theta_2$ and $\theta_3$ of the air bags 110*a*, 110*b* and 110*c* at different time points are detected and recorded so as to plot a P-t graph as shown by FIG. 3. The baro sensors S1, S2 and S3 are respectively connected to the above-mentioned air bags 110*a*, 110*b* and 110*c* at the angle positions $\theta_1$, $\theta_2$ and $\theta_3$ to obtain the P-t graph, wherein, as shown in FIG. 3, the solid line, the broken line and dot line respectively represent the curves of the pressure measured by the baro sensors S1, S2 and S3 at different time points.

Herein $\theta_0=0$, and $\theta_1$, $\theta_2$, $\theta_3$, $\theta_x$ and $\theta_e$ represent the angles from the zero degree position $\theta_0$ to the angle positions of the air bags along the air bags 110*a*, 110*b* and 110*c* in a same clock direction (for example, clockwise or anticlockwise; in FIG. 2, the angles are counted anticlockwise).

When a collision occurs at time $t_0$, the obstructing object 50 can be a general a fixed obstructing object, for example, wall corner, a non-fixed obstructing object, for example, garbage on floor or a moving obstructing object, for example, an animal. When the obstructing object 50 collides the air bag 110*a*, the corresponding P-t graph reflecting the pressure variations measured at the angle positions $\theta_1$, $\theta_2$ and $\theta_3$ is shown by FIG. 3.

It is revealed that since the collision angle position $\theta_x$ is more close to the baro sensor S1, therefore, the curve (solid line) measured at the angle $\theta_1$ records the most occurred pressure variations with the greatest variation amount. After that, the pressure variations are transmitted away through the through holes 112. Thus, the next occurred pressure variations are detected at the $\theta_2$ represented by the broken line and the pressure variations occurred in the most delay is corresponding to the dot line detected at the $\theta_3$.

Each of the pressure curves is expected to have a leak value and approaches a slowly-declining value prior to releasing the collision force. The declining rate approaching the slowly-declining value is related to the employed baro sensor. If a pressure-discharging sensor were employed, the slowly-declining rate should be somewhat faster, while if a discharging-proof sensor were employed, the slowly-declining rate should be somewhat slower.

Next, in step S120, it is judged whether an air bag is collided by means of the pressure variations measured at the angle positions $\theta_1$, $\theta_2$ and $\theta_3$ prior to and after the collision.

If it is judged that an air bag is collided, the corresponding collision force would be calculated in step S130 by means of the pressure variations measured at the angle positions $\theta_1$, $\theta_2$ and $\theta_3$ of the air bags 110*a*, 110*b* and 110*c*. Herein, the maximum pressures measured at the angle positions $\theta_1$, $\theta_2$ and $\theta_3$ are respectively $P_1$, $P_2$ and $P_3$, and the differential pressure between $P_1$ and $P_2$ and the differential pressure between $P_2$ and $P_3$ are respectively represented by $\Delta P_1$ and $\Delta P_2$.

The method to calculate a collision force by means of the pressure variations includes, for example, the following steps: performing a set of experiments in advance, wherein the air bags are collided with different collision forces in different angles and the pressure differences $\Delta P_1$ and $\Delta P_2$ of the air bags under the different collision forces are recorded so as to establish a look-up table; and calculating the collision forces corresponding to the occurred collisions by using the look-up table.

Next, in step S140, assuming a collision occurs at an collision angle position $\theta_x$ and a time point $t_0$, when the detected pressures at the angle positions $\theta_1$, $\theta_2$ and $\theta_3$ reach a preset pressure (for example, the detected pressure reaches the maximal value $P_{max}$ or a preset reference pressure $P_{ref}$, or the detected pressure reaches a starting rising point $P_{rise}$), the time points $t_1$, $t_2$ and $t_3$ are recorded. Referring to FIG. 3, since the baro sensors S1, S2 and S3 keep detecting the pressures at the angle positions $\theta_1$, $\theta_2$ and $\theta_3$, therefore, the time points $t_1$, $t_2$ and $t_3$ for the pressures to reach the preset pressure are known, but the time point of collision occurrence $t_0$ is unknown.

Next, in step S150, assuming v represents pressure wave speed during transmitting the pressure between the air bags and the following equations are listed to determine the collision angle position $\theta_x$:

$$v(t_1-t_0)=\min\{R(\theta_1-\theta_x),R[\theta_x+(\theta_e-\theta_1)]\}$$

$$v(t_2-t_0)=\min\{R(\theta_2-\theta_x),R[\theta_x+(\theta_e-\theta_2)]\}$$

$$v(t_3-t_0)=\min\{R(\theta_3-\theta_x),R[\theta_x+(\theta_e-\theta_3)]\}$$

In the above equations, the function min{ } represents an operation to take the minimal value among values within the bracket, the unknown variables are v, $t_0$ and $\theta_x$ and the remaining variables are known; therefore, the unique solutions of v, $t_0$ and $\theta_x$ can be obtained.

The left side of the above-mentioned equations indicates a physical meaning that the left side is equal to the pressure wave travelling distance from the collision position to each baro sensor. The reason for the right side of the equations to take a function min{ } rests in that after a collision occurs, the pressure wave always takes the shortest travelling distance to arrive all the baro sensors.

It was found from a number of experiments that the three time differences between every two pressure curves detected at different angles in FIG. 3 are very close to each other.

Once the time points $t_1$, $t_2$ and $t_3$ corresponding to the maximum pressures of the curves are recorded, the time differences of every two baro sensors are: $\Delta t_1=t_2-t_1$ (the time difference when the pressures measured by the baro sensors S1 and S2 reach the maximal values, respectively), $\Delta t_2=t_3-t_2$ (the time difference when the pressures measured by the baro sensors S2 and S3 reach the maximal values, respectively) and $\Delta t_3=t_3-t_1$ (the time difference when the pressures measured by the baro sensors S1 and S3 reach the maximal values, respectively).

If the criteria is referred to a preset reference pressure $P_{ref}$, once the time points $t_1'$, $t_2'$ and $t_3'$ corresponding to the moments at which the curves reach the preset reference pressure $P_{ref}$ are recorded, the time differences of every two baro sensors are: $\Delta t_1'=t_2'-t_1'$, $\Delta t_2'=t_3'-t_2'$ and $\Delta t_3'=t_3'-t_1'$.

If the criteria is referred to the moment at which the curves start to rise, once the time points $t_1''$, $t_2''$ and $t_3''$ are recorded, the time differences of every two baro sensors are: $\Delta t_1''=t_2''-t_1''$, $\Delta t_2''=t_3''-t_2''$ and $\Delta t_3''=t_3''-t_1''$.

Based on the characteristic that the time differences of $\Delta t_1$, $\Delta t_1'$ and $\Delta t_1''$ are close to each other, the time differences of $\Delta t_2$, $\Delta t_2'$ and $\Delta t_2'$ are close to each other and the time differences of $\Delta t_3$, $\Delta t_3'$ and $\Delta t_3'$ are close to each other, a table-checking method to calculate a collision angle position $\theta_x$ is further provided.

To establish a look-up table, a set of experiments are performed. The air bags are placed along the whole periphery of the main body 100 and a plurality of collisions in a fixed collision force is conducted at every one degree interval along the whole periphery of 360 degree. Meanwhile, the $\Delta t_1$, $\Delta t_2$ and $\Delta t_3$ corresponding to each collision angle are recorded, followed by taking every two of them ($\Delta t_1$ and $\Delta t_2$, $\Delta t_2$ and $\Delta t_3$, $\Delta t_1$ and $\Delta t_3$) to establish a look-up table with three independent variables. Thus, a collision angle position $\theta_x$ can be obtained according to $\Delta t_1$ and $\Delta t_2$, or $\Delta t_2$ and $\Delta t_3$, or $\Delta t_1$ and $\Delta t_3$.

By using the table-checking method, time differences for any two baro sensors to reach $P_{max}$, $P_{ref}$ or $P_{rise}$ are used to find out the collision angle position $\theta_x$.

In the embodiment, through holes capable of delaying a pressure transmission are used to make the air bags communicated with each other. In this way, the time differences of the curves in FIG. 3 can be prolonged, which makes the sampling time of the baro sensors not too short while remaining an accurate sensing result.

In the embodiment, three air bags are arranged in a ring to enclose the whole periphery of the main body (360 degree). The air bags incorporated with three baro sensors detect the P-t curves of the air bags; thus, any collision angle at any position of the whole periphery can be measured.

Furthermore in the embodiment, three baro sensors are disposed at any positions, which are not limited to an equal interval arrangement.

In the above-mentioned embodiment, the number of the air bags and the baro sensors to detect a collision angle along the whole periphery are three, respectively; but the number can be more than three, respectively.

The Second Embodiment

Figure 5:
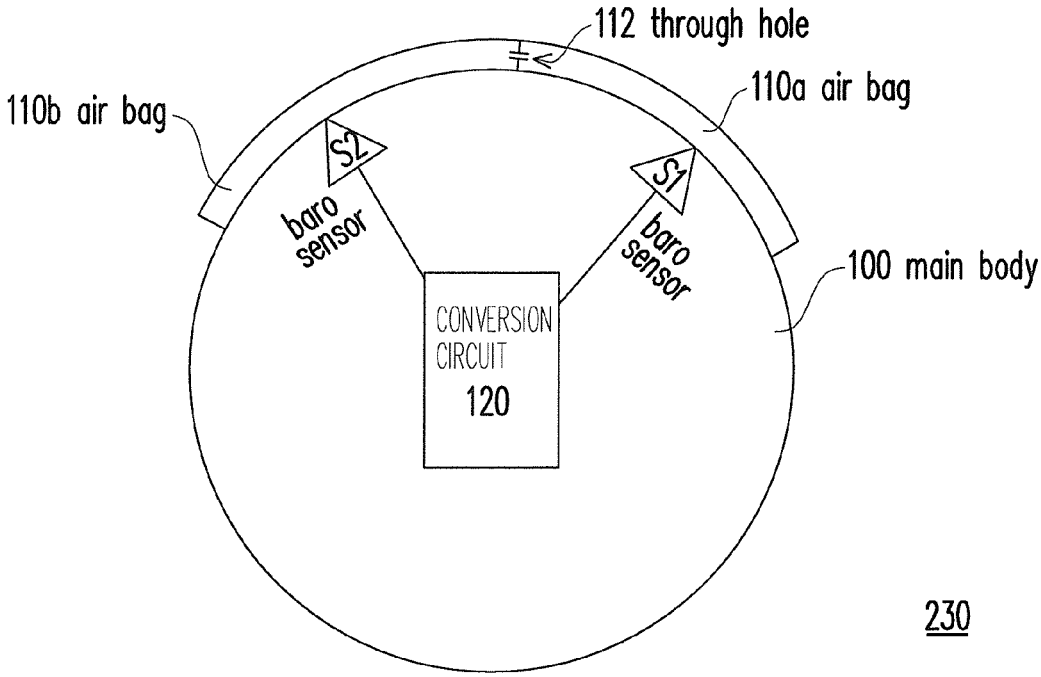
FIG. 5 is a top view diagram of a collision detection apparatus according to a second embodiment of the present invention.

If a collision-detecting is focused on a certain range on the main body without detecting the whole periphery, a collision detection apparatus 230 shown by FIG. 5 is preferred, where at least an air bag (for example, two air bags 110*a* and 110*b* are employed and shown in FIG. 5) arranged in a sector and fixed along the periphery of the main body 100 and at least a baro sensor (for example, two baro sensors S1 and S2 are used in FIG. 5) are employed. In FIG. 5, all the same components as the first embodiment are represented by the same marks and they are omitted to describe.

The collision-detecting operations are similar to the first embodiment, so that the description of collision and the collision force within the range covered by the air bags 110*a* and 110*b* is not repeated again.

The Third Embodiment

Figure 6:
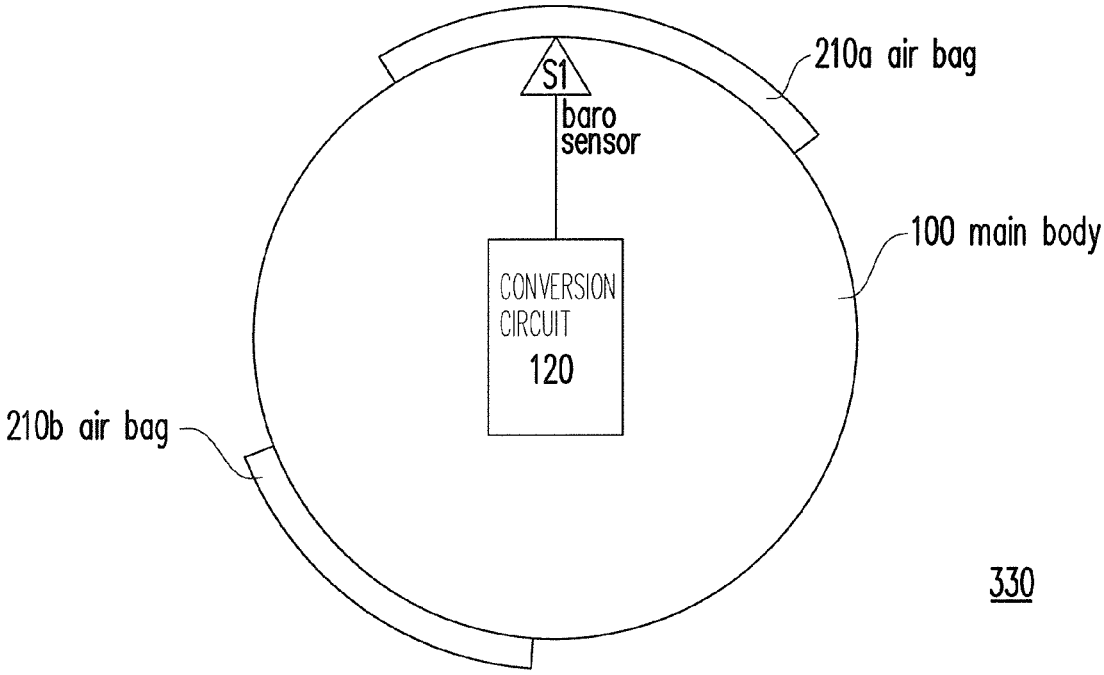
FIG. 6 is a top view diagram of a collision detection apparatus according to a third embodiment of the present invention.

If only the collision force is concerned and there is no need to detect the collision angle/collision position, the collision detection apparatus 330 shown by FIG. 6 is preferred, where at least an air bag (for example, two air bags 210*a* and 210*b* are employed and shown in FIG. 6) and at least a baro sensor S1 are employed. There is no need for the air bags to communicate with each other. Here, the baro sensor S1 is connected to the air bag 210*a* to detect the pressure variation of the air bag 210*a*, while the air bag 210*b* serves for collision-proof only without connecting a baro sensor. In FIG. 6, all the same components as the first embodiment are represented by the same marks and description thereof is not repeated again.

The Fourth Embodiment

In the collision detecting method of the first embodiment, the given detection angles are used to find out the collision angle; however, the method can be modified to use the given detection positions (the distance counted from the starting point) to determine the collision position (the distance counted from the start point up).

Figure 7:
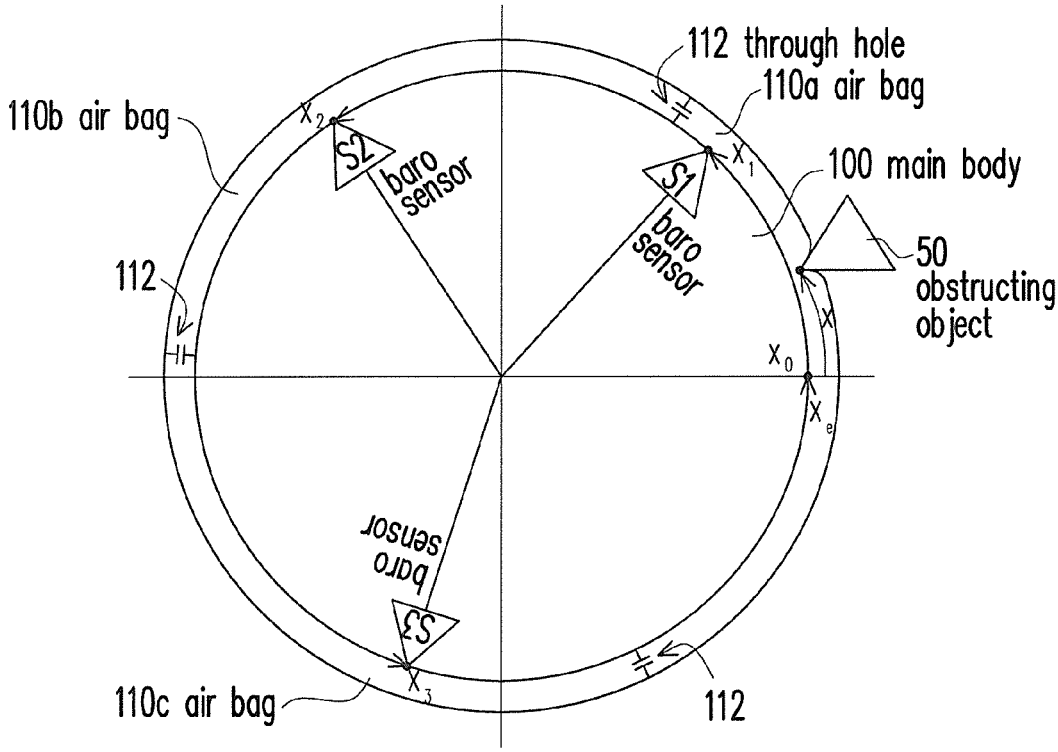
FIG. 7 is a diagram illustrating a collision detection apparatus during a collision according to a fourth embodiment of the present invention.
Figure 8:
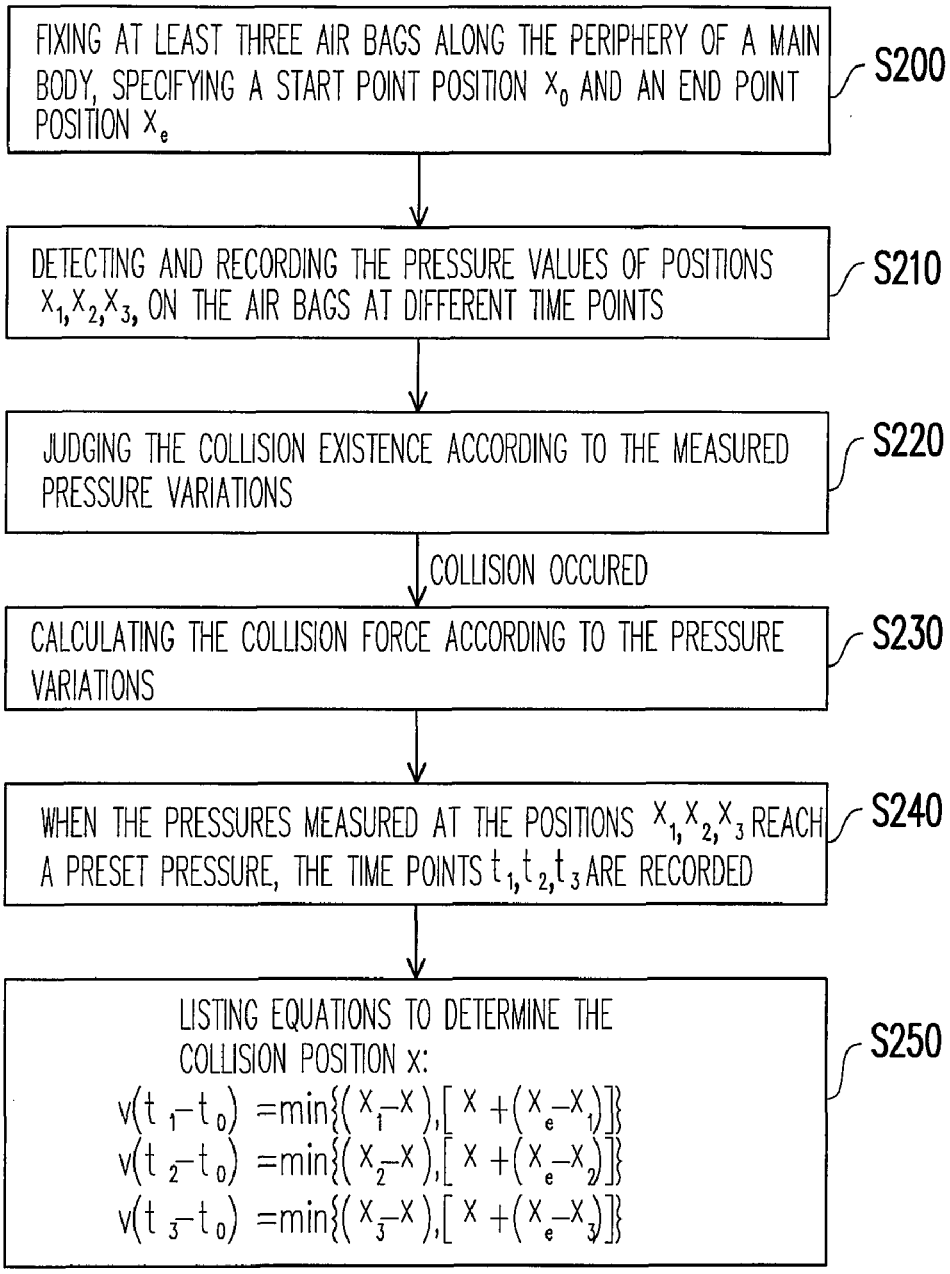
FIG. 8 is a flowchart showing the collision detection method of the collision detection apparatus in FIG. 7.

FIGS. 7 and 8 illustrate the collision detecting method according to the fourth embodiment of the present invention. FIG. 7 is a diagram illustrating a collision detection apparatus during a collision according to the fourth embodiment of the present invention, while FIG. 8 is a flowchart showing the collision detection method of the collision detection apparatus in FIG. 7. In FIG. 7, all the same components as the first embodiment are represented by the same marks and description thereof is omitted.

In step S200, at least three air bags are fixed along the periphery of the main body 100. In FIG. 7, for example, three air bags 110*a*, 110*b* and 110*c* are employed and are positioned adjacent to each other. The air bags are arranged in a sector or a ring (for example, the air bags in FIG. 7 enclose the whole periphery of the main body 100). In addition, a start position $x_0$ and an end position $x_e$ are specified (for the case of enclosing the whole periphery, $x_e$ is equal to the entire periphery length of the main body).

The main body 100 can be the main body of a robot or the main body of a vacuum cleaner depending on the object with a need to detect collision.

Next, in step S210, the pressure values at the positions $x_1$, $x_2$ and $x_3$ respectively corresponding to the air bags 110*a*, 110*b* and 110*c* at different time points are detected and recorded, so as to plot a P-t graph as shown by FIG. 3. The baro sensors S1, S2 and S3 are connected to the above-mentioned positions $x_1$, $x_2$ and $x_3$ of the air bags 110*a*, 110*b* and 110*c* to obtain a P-t graph.

Herein $x_0=0$, and $x_1$, $x_2$, $x_3$, x and $x_e$ represent the distances from the start position $x_0$ to the positions of the air bags along the air bags 110*a*, 110*b* and 110*c* in a same clock direction (for example, clockwise or anticlockwise; in FIG. 7, for example, the distances are counted anticlockwise).

When a collision occurs at time $t_0$, the obstructing object 50 can be a general fixed obstructing object, for example, wall corner, a non-fixed obstructing object and a fixed obstruct can be, for example, wall corner, while a non-fixed obstruct, for example, garbage on floor or a moving obstruct, for example, an animal. When the obstructing object 50 collides the air bag 110*a*, the pressure variations measured at the $x_1$, $x_2$ and $x_3$ are shown by FIG. 3.

Next, in step S220, it is judged whether an air bag is collided by means of the pressure variations measured at the positions $x_1$, $x_2$ and $x_3$ prior to and after the collision.

If it is judged that an air bag is collided, the corresponding collision force would be calculated in step S230 by means of the pressure variations measured at the positions $x_1$, $x_2$ and $x_3$ of the air bags 110*a*, 110*b* and 110*c*. Herein, the maximum pressures measured at the positions $x_1$, $x_2$ and $X_3$ are respectively $P_1$, $P_2$ and $P_3$, and the differential pressure between $P_1$ and $P_2$ and the differential pressure between $P_2$ and $P_3$ are respectively represented by $\Delta P_1$ and $\Delta P_2$.

The method of calculating a collision force by means of pressure variations includes, for example, table-checking method.

Next, in step S240, assuming a collision occurs at a collision position x and a time point $t_0$, when the detected pressures at the positions $x_1$, $x_2$ and $x_3$ reach a preset pressure (for example, the detected pressure reaches the maximal value $P_{max}$ or a preset reference pressure $P_{ref}$, or the detected pressure reaches a starting rising point $_{rise}$), the time points $t_1$, $t_2$ and $t_3$ are recorded. Referring to FIG. 3, since the baro sensors S1, S2 and S3 keep detecting the pressures at the positions $x_1$, $x_2$ and $x_3$, therefore, the time points $t_1$, $t_2$ and $t_3$ for the pressures to reach the preset pressure are known, but the time point of collision occurrence $t_0$ is unknown.

Next, in step S250, assuming v represents pressure wave speed during transmitting the pressure between the air bags and the following equations are listed to find out the collision position x:

$$v(t_1-t_0)=\min\{(x_1-x),[x+(x_e-x_1)]\}$$

$$v(t_2-t_0)=\min\{(x_2-x),[x+(x_e-x_2)]\}$$

$$v(t_3-t_0)=\min\{(x_3-x),[x+(x_e-x_3)]\}$$

Herein the function min{ } represents an operation to take the minimal value among all values within the bracket, the unknown variables are v, $t_0$ and x and the rest variables are known; therefore, the unique solutions of v, $t_0$ and x can be obtained.

THE MODIFICATION EXAMPLE

In the first embodiment, the air bags are connected to each other in a ring arrangement; thus, in order to calculate distances from the collision position to the baro sensor positions for the pressure wave to travel across, the distances can be obtained by timing the radius R by the corresponding radian [rad]. If the air bags are not connected to each other in a ring arrangement, the distances from the collision position to the baro sensor positions for the pressure wave to travel across can not be obtained by timing the radius R by the corresponding radian [rad]. However, the method of the fourth embodiment can be used as well, so that a collision position is calculated by using the known detection positions (distances).

Figure 9:
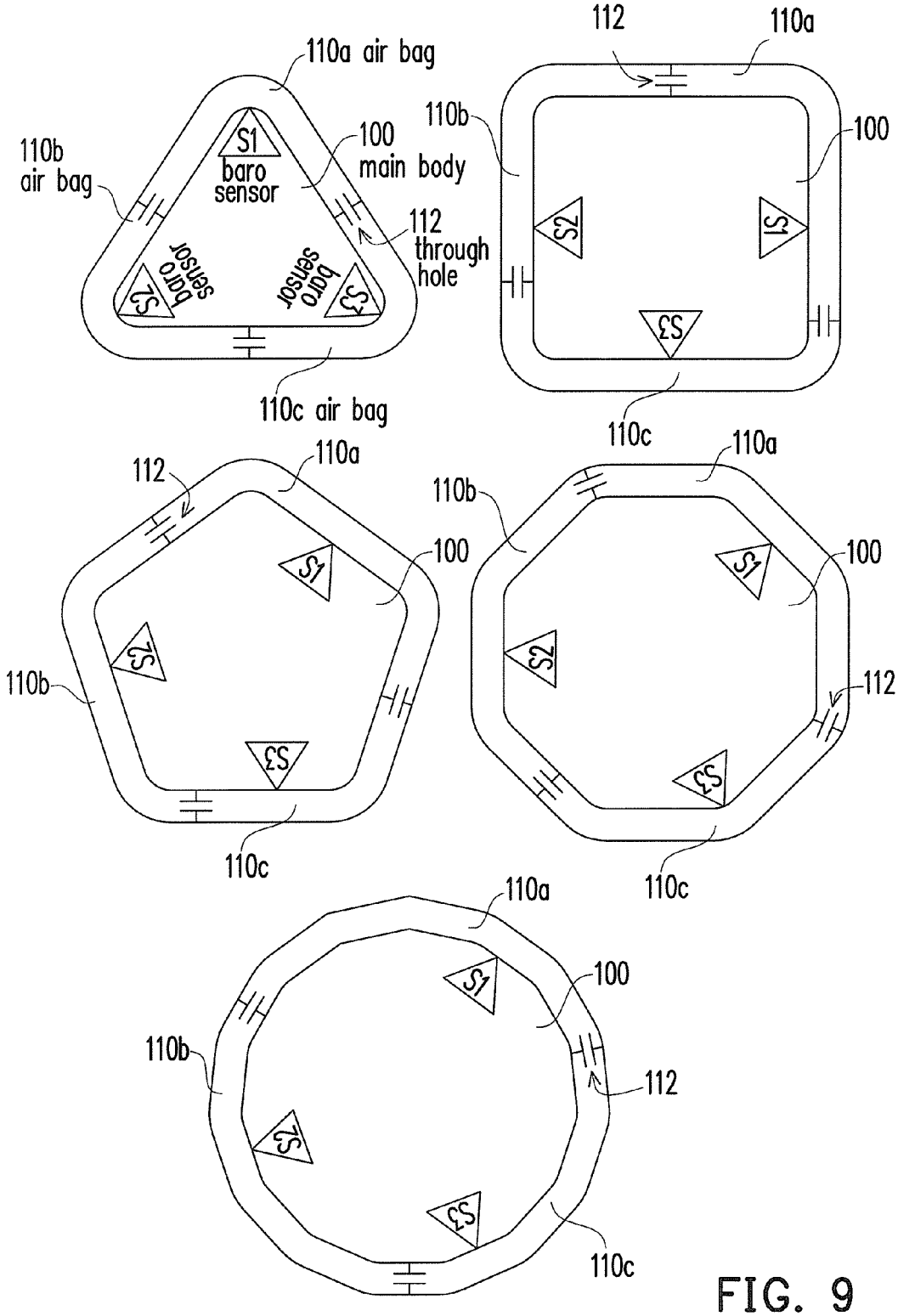
FIG. 9 is a diagram illustrating several variations of the collision detection apparatus based on a preferred embodiments of the present invention.

Accordingly, the collision detecting method of the fourth embodiment is suitable for the modification example shown by FIG. 9.

In all the above-mentioned embodiments, the relationships between pressure variations and time are used to judge whether a collision occurs and calculate the collision force.

It can be seen from the equations in the above-described first embodiment and fourth embodiment that three air bags and three baro sensors are enough to list three equations to get a unique solution, and for the case where more than three air bags and more than three baro sensors are used, a unique solution can be obtained as well. If the air bags enclose the whole periphery of the main body, the time point of collision occurrence and the collision position/collision angle in the entire orientation can be accurately obtained. If the air bags cover a certain range of the main body, the time point of collision occurrence and the collision position/collision angle within the range can be accurately obtained.

If only one or two air bags are used, the information of a collision existence and the collision force still can be obtained by means of the relationships between pressure variations and time.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A collision detecting method, comprising:

fixing at least three air bags along a periphery of a main body and specifying a start point position $x_0$ and an end point position $x_e$, wherein the air bags communicate with each other via at least two through holes, so that a pressure transmission between the air bags and delay of the pressure transmission are implemented by said at least two through holes;

detecting and recording pressure values at positions $x_1$, $x_2$ and $x_3$ respectively of the air bags at different time points;

judging whether a collision occurs and calculating a collision force according to pressure variations measured at the positions $x_1$, $x_2$ and $x_3$ on the air bags;

wherein when it is judged that a collision has occurred at a collision position x and time point $t_0$, time points $t_1$, $t_2$ and $t_3$ are recorded when detected pressures at the position $x_1$, $x_2$ and $x_3$ reach a preset pressure, wherein $x_1$, $x_2$, $x_3$ and $x_e$ respectively represent distances from the start point position $x_0$ to the positions on the air bags along the air bags in a same clock direction; and using following equations $$v(t_1-t_0)=\min\{(x_1-x),[x+(x_e-x_1)]\}$$

$$v(t_2-t_0)=\min\{(x_2-x),[x+(x_e-x_2)]\}$$

$$v(t_3-t_0)=\min\{(x_3-x),[x+(x_e-x_3)]\}$$

wherein v represents pressure wave speed during the pressure transmission between the air bags and determining v, $t_0$ and the collision position x, and wherein the function min{ } represents an operation having a minimal value among values within the bracket.

2. The collision detecting method according to claim 1, wherein reaching a preset pressure means pressures of the air bags measured at the positions $x_1$, $x_2$ and $x_3$ respectively reach maximum values.

3. The collision detecting method according to claim 1, wherein reaching a preset pressure means pressures of the air bags measured at the positions $x_1$, $x_2$ and $x_3$ respectively reach a preset reference pressure.

4. The collision detecting method according to claim 1, wherein reaching a preset pressure means pressures of the air bags measured at the positions $x_1$, $x_2$ and $x_3$ respectively start rising.

5. The collision detecting method according to claim 1, wherein the air bags are connected to each other surrounding the periphery of the main body.

6. The collision detecting method according to claim 5, wherein the method of calculating the collision force according to pressure variations comprises:

performing a set of experiments including performing a plurality of collisions on the air bags with different collision forces and recording pressure variations of the air bags under the different collision forces so as to establish a look-up table; and calculating a collision force corresponding to a collision by using the look-up table.

7. The collision detecting method according to claim 1, further comprising a step of calculating a collision force according to pressure variations at the positions $x_1$, $x_2$ and $x_3$ prior to and after the collision.

8. The collision detecting method according to claim 1, wherein the air bags comprise an elastic material and are integrally formed.

9. A collision detection apparatus, comprising:

a main body;

at least three air bags, arranged in a ring and fixed along a periphery of the main body;

a plurality of baro sensors, respectively connected to the air bags, for detecting a pressure variation of the air bags;

a conversion circuit, for converting a signal measured by each of the baro sensors into an analog or digital electrical signal; and wherein a through hole is formed between every two adjacent air bags for achieving pressure transmission between the air bags and delaying the pressure transmission, and a collision is judged and a collision force is calculated by means of pressure variations measured by and between the baro sensors.

10. The collision detection apparatus according to claim 9, wherein the air bags are arranged in a sector and fixed along the periphery of the main body.

11. The collision detection apparatus according to claim 9, wherein the air bags are comprised of elastic material.

12. A robot, comprising a collision detection apparatus as claimed in claim 9.

13. A vacuum cleaner, comprising a collision detection apparatus as claimed in claim 9.

14. A collision detection apparatus, comprising:

a main body;

a plurality of air bags, disposed at a periphery of the main body;

a plurality of baro sensors, respectively connected to the air bags, for detecting a pressure variation of the air bags;

a conversion circuit, for converting a signal measured by each of the baro sensors into an analog or digital electrical signal; and wherein at least a through hole is formed between any two adjacent air bags for achieving pressure transmission between the air bags and delaying the pressure transmission, and a collision is judged and a collision force is calculated by means of pressure variations measured by the baro sensors, and the air bags communicate with each other and the baro sensors detect a pressure of each of the air bags at different time points and determine a collision range of the main body covered by the air bags by means of the pressure of each of the air bags at different time points.

15. The collision detection apparatus according to claim 14, wherein the air bags are positioned adjacent to each other, and are arranged in a sector and fixed along the periphery of the main body.

16. The collision detection apparatus according to claim 15, wherein the air bags are integrally formed.

17. The collision detection apparatus according to claim 14, wherein the air bags are positioned adjacent to each other, arranged in a ring and fixed along the periphery of the main body.

18. The collision detection apparatus according to claim 17, wherein the air bags are integrally formed.

19. A robot, comprising a collision detection apparatus as claimed in claim 14.

20. A vacuum cleaner, comprising a collision detection apparatus as claimed in claim 14.

21. A collision detection method, comprising:

fixing at least three air bags along a periphery of a main body, wherein the air bags are positioned adjacent to each other and are arranged in a sector or a ring with a radius R with a zero degree position $\theta_0$ and an end point angle position $\theta_e$, and wherein the air bags communicate with each other via at least two through holes so that a pressure transmission between the air bags and delay of the pressure transmission can be achieved via said at least two through holes;

detecting and recording pressure values at angle positions $\theta_1$, $\theta_2$ and $\theta_3$ respectively corresponding to the air bags at different time points;

judging whether a collision occurs and calculating collision force according to pressure variations on the air bags measured at the angle positions $\theta_1\theta_2$ and $\theta_3$;

wherein when it is judged that a collision occurred at a collision angle position $\theta_x$ at time point $t_0$, time points $t_1$, $t_2$ and $t_3$ are recorded when detected pressures at the angle positions $\theta_1\theta_2$ and $\theta_3$ reach a preset pressure, wherein $\theta_1\theta_2,\theta_3$ and $\theta_e$ respectively represent angles from the zero degree position $\theta_0$ to the angle positions on the air bags along the air bags in a same clock direction; and using the following equations:

$$v(t_1-t_0)=\min\{R(\theta_1-\theta_x),R[\theta_x+(\theta_e-\theta_1)]\}$$

$$v(t_2-t_0)=\min\{R(\theta_2-\theta_x),R[\theta_x+(\theta_e-\theta_2)]\}$$

$$v(t_3-t_0)=\min\{R(\theta_3-\theta_x),R[\theta_x+(\theta_e-\theta_3)]\}$$

wherein v represents pressure wave speed during pressure transmission between the air bags and determining v, $t_0$ and the collision angle position $\theta_x$, and wherein the function min{ }represents an operation with minimal value among values within the bracket.

* * * * *